US006273640B1

(12) United States Patent
Suazo

(10) Patent No.: US 6,273,640 B1
(45) Date of Patent: Aug. 14, 2001

(54) IRRIGATION DITCH LINER

(75) Inventor: Kenneth L. Suazo, Espanola, NM (US)

(73) Assignee: Fast Ditch, Inc., Vallecitos, NM (US)

( * ) Notice: Subject to any disclaimer, the term of this patent is extended or adjusted under 35 U.S.C. 154(b) by 0 days.

(21) Appl. No.: 09/158,204

(22) Filed: Sep. 22, 1998

(51) Int. Cl.[7] ..... E02B 13/00

(52) U.S. Cl. ..... 405/121; 405/118; 405/49; 52/11; 52/16; 404/2

(58) Field of Search ..... 405/119, 121, 405/118, 49; 404/2–4; 52/16, 11; 403/300, 305

(56) References Cited

U.S. PATENT DOCUMENTS

| | | | |
|---|---|---|---|
| 210,442 | 3/1878 | Page . | |
| 2,582,515 | 1/1952 | Warp . | |
| 2,657,074 | 10/1953 | Schwester et al. | 285/90 |
| 3,313,319 | 4/1967 | Osborn et al. | 138/121 |
| 3,315,704 | 4/1967 | Shire | 138/121 |
| 3,336,950 | 8/1967 | Fochler | 138/121 |
| 4,257,716 | 3/1981 | Woodrow | 405/118 |

FOREIGN PATENT DOCUMENTS

| | | |
|---|---|---|
| 1248204 | 9/1971 | (GB) . |

*Primary Examiner*—David Bagnell
*Assistant Examiner*—Frederick L. Lagman

(57) ABSTRACT

An irrigation ditch liner system comprises a plurality of liner sections including at least one straight conduit section and one corrugated conduit section, each conduit having a semi-cylindrical body portion defining a conduit interior diameter, vertical walls extending from the semi-cylindrical body portion, and end sections having extending end flanges with an interior diameter greater than said conduit interior diameter. A connecting joint is provided with an outer wall and an inner wall, the inner wall having a interior diameter the same as the conduit interior diameter, where the outer wall of the connecting joint further defines a depending lip that captures the end flanges between the inner wall and the outer wall of the connecting joint.

5 Claims, 3 Drawing Sheets

IRRIGATION DITCH LINER

BACKGROUND OF THE INVENTION

This invention relates to irrigation systems and, more particularly, to liners for irrigation ditches.

In many parts of the world, irrigation of farmland is done by diverting water from rivers and streams, and the like, through ditches to the land to be watered. These ditches may be many miles in length and substantial maintenance is required on natural ditches, i.e., ditches with earth walls. Where the sources of the irrigation water are mountain streams, the ditches may meander in rugged country to reach the many fields that are irrigated by a single ditch.

It will be appreciated that natural ditches deteriorate throughout the year. Ditch walls collapse; debris fills the ditch when water is not flowing. In addition, substantial water is lost by absorption through the dirt walls. Also, animals burrow through earthen ditch banks, with a resulting loss of water.

Where the irrigation ditch is in flat, accessible ground, it is possible to line the ditch with a permanent material, such as concrete. This requires, however, substantial equipment for delivering and forming the concrete to the ditch. Concrete lined ditches are also very expensive to construct. It is desirable to provide a ditch liner that can be installed relatively inexpensively and in remote locations.

Accordingly, it is an object of the present invention to provide a transportable ditch liner that can be readily installed with simple tools.

It is another object of the present invention to provide a transportable, lightweight ditch liner that can be readily conformed to the path of existing natural irrigation ditches.

Many objects, advantages and novel features of the irrigation ditch liner will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise an irrigation ditch liner system. The irrigation ditch liner system comprises a plurality of connectable liner sections including at least one straight conduit section and one corrugated conduit section, each conduit having a semi-cylindrical body portion defining a conduit interior diameter, integral vertical walls extending from the semi-cylinrical body portion, and end sections having extending end flanges with an interior diameter greater than said conduit interior diameter.

In a preferred embodiment, a connecting joint is provided with an outer wall and an inner wall, the inner wall and the outer wall having converging end portions to engage extending end flanges of adjacent liner sections, where the inner wall has a diameter substantially the same as the conduit diameter to form a smooth connection region.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

In accordance with the present invention, an irrigation ditch liner system is provided for installation into existing natural irrigation ditches, i.e., ditches with earth walls, or as a freestanding conduit structure. Individual liner sections provide for in-situ assembly and tie-down of individual conduit sections and for the delivery of irrigation water to selected plots of land. It is expected that the liner system will greatly facilitate cleaning of irrigation ditches and greatly reduce the loss of water through the ditch walls.

Figure 1:
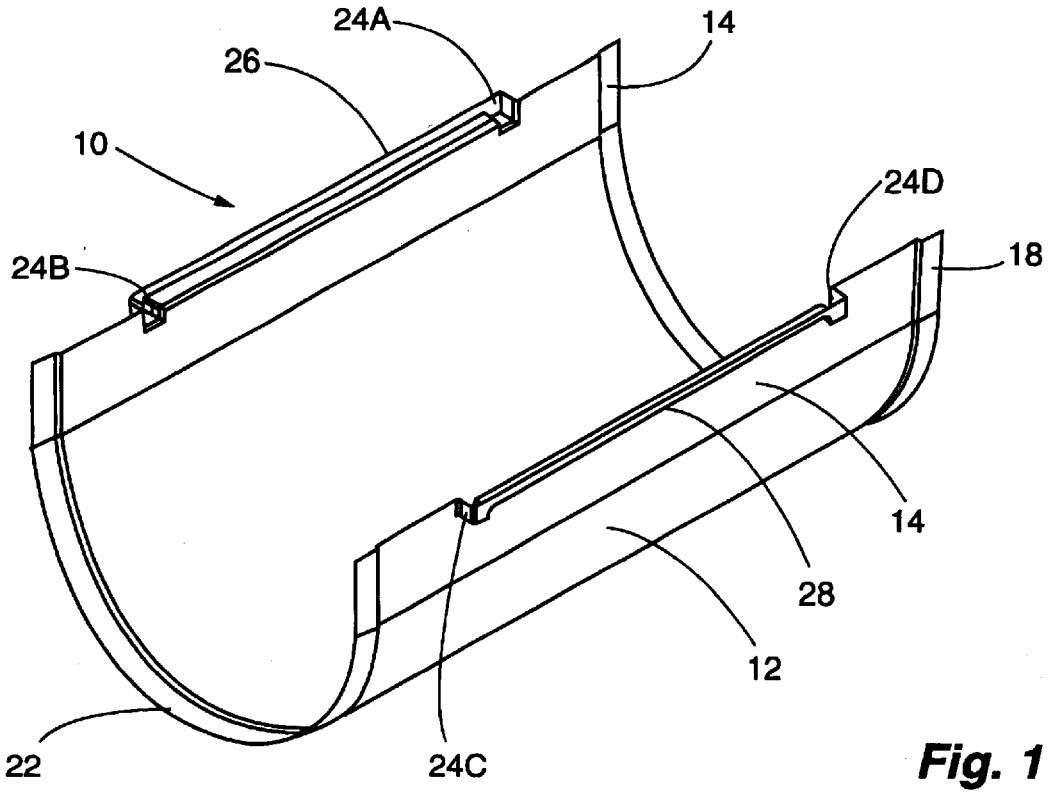
FIG. 1 is an isometric illustration of a rigid, straight ditch liner conduit according to the present invention.

FIG. 1 is an isometric illustration of rigid, straight conduit 10 of the irrigation liner system according to the present invention. Conduit 10 includes a semi-cylindrical portion 12 for placing within existing irrigation ditch paths, where available, and integral vertical sides 14 extending from semi-cylindrical portion 12 to provide additional volume for water flow without increasing the radius of semicylindrical portions 12.

Conduit 10 includes connector flanges 18, 22 for use in joining adjacent conduit sections, as further discussed below. Conduit 10 may need to be secured to the ground to maintain the conduit in place when subjected to dimensional variations from thermal expansion and contraction, from forces exerted by flowing water, and from inadvertent contact from humans and animals. Brackets 24A–24D are formed on vertical sides 14 of conduit 10 to provide an attachment capability to secure the conduit and to serve as handles in carrying the liner. Securing devices, such as long rods, tie ropes, and the like, may be inserted through holes in the brackets to secure the conduit to the ground. Brackets 24A–24D are preferably formed integral with upstanding wall portion 14, but may be formed as individual pieces that are attached to conduit 10 as needed.

FIG. 1 also shows longitudinal flanges 26, 28 that are formed along vertical sides 14, generally between tie-down brackets 24A, 24B and 24C, 24D, respectively. Flanges 26, 28 are preferably formed integral with vertical sides 14, but may be separate longitudinal pieces that are attached to vertical sides 14. It will be appreciated that variety of bracket and flange configurations may be designed that are within the scope of the present invention and any number of securing devices are within the skill of a mechanical designer so that the exact configuration shown in FIG. 1, and expressly described herein, is not intended to be limiting.

Figure 2:
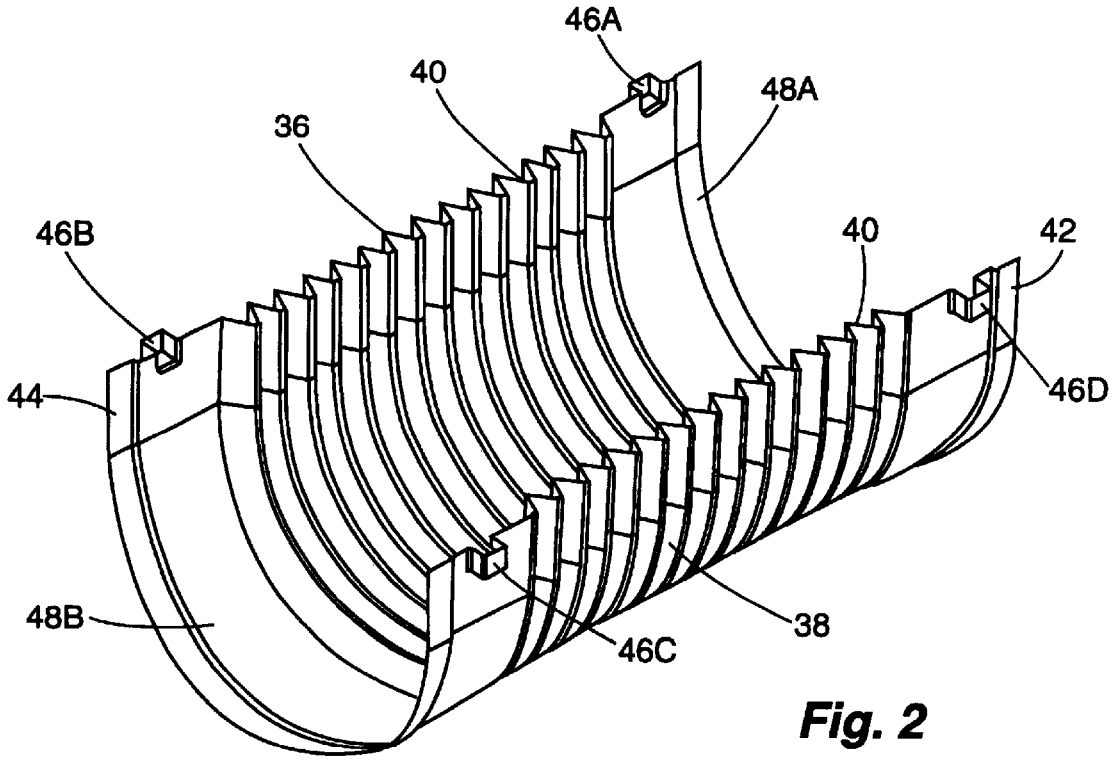
FIG. 2 is an isometric illustration of a corrugated flexible irrigation ditch liner conduit according to the present invention.

FIG. 2 is an isometric illustration of a second conduit 36 for use in the irrigation system of this invention. Conduit 36 is formed of semi-cylindrical corrugated portion 38 having integral vertical corrugated sides 40 integral therewith. In a preferred design, the maximum diameter of the corrugations is less than the outer diameter of straight conduits 10. Straight conduit portions 48A, 48B are provided at end portions of conduit 36 for securing and joining conduit 36 with abutting conduits. As shown and described above for straight conduit 10 in FIG. 1, connector flanges 42, 44 extend from straight portions 48A, 48B, respectively, for mating with an abutting conduit. Likewise, tie-down brackets 46A–46D are connected to vertical portion 42 along straight portions 48A, 48B, either integrally or separately, for use in securing conduit 36 in a selected location.

Corrugated conduit 36 sections are required in order to accommodate thermal expansion and contraction throughout the length of an assembled system. For example, if the conduits are formed of conventional plastics, such as high density polyethylene and polyvinyl chloride, with sections having 5 foot, 6 inch lengths, it is estimated that one corrugated conduit 36 will be required for every three straight conduits 10 (FIG. 1). The corrugations also provide an inherent flexibility to conduit 36 so that the assembled ditch liner system can follow a meandering irrigation ditch, such as acequias found in many parts of the southwest.

Figure 3A:
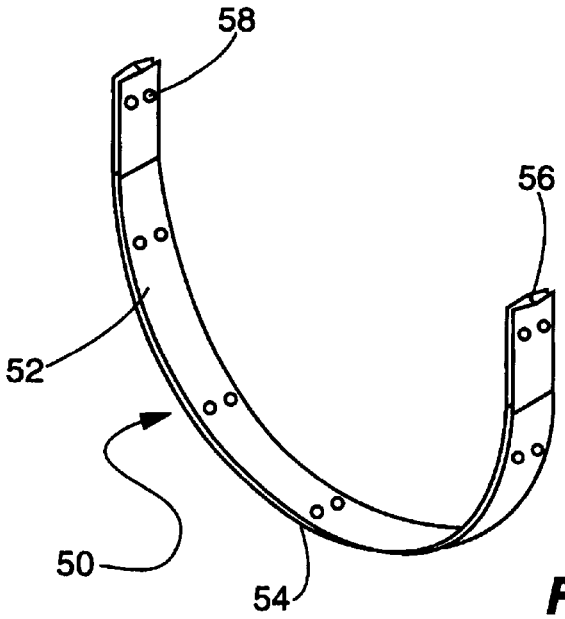
FIG. 3A is an isometric illustration of joint for connecting adjacent conduit sections.
Figure 3B:
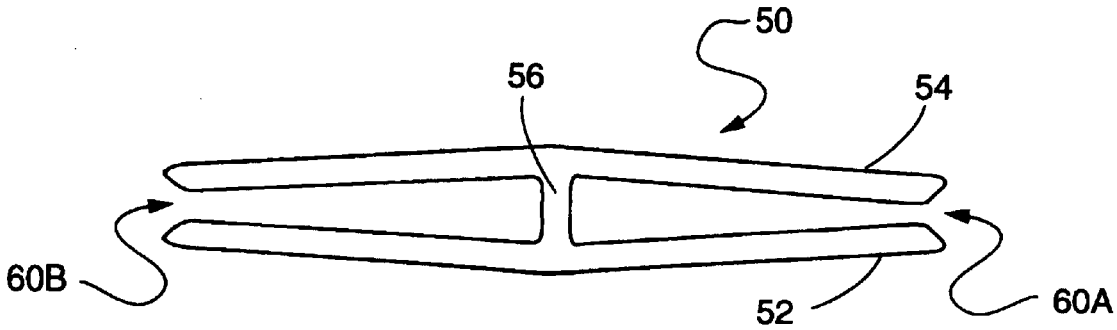
FIG. 3B is a cross-section view of an assembled liner joint.
Figure 3C:
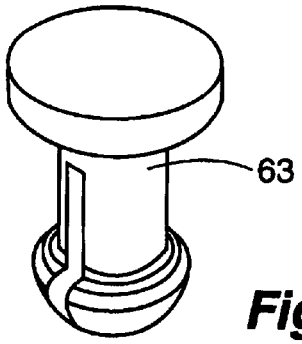
FIG. 3C is a pictorial illustration of a rivet for securing the joint of FIG. 3A to conduit sections shown in FIGS. 1 and 2.
Figure 4:
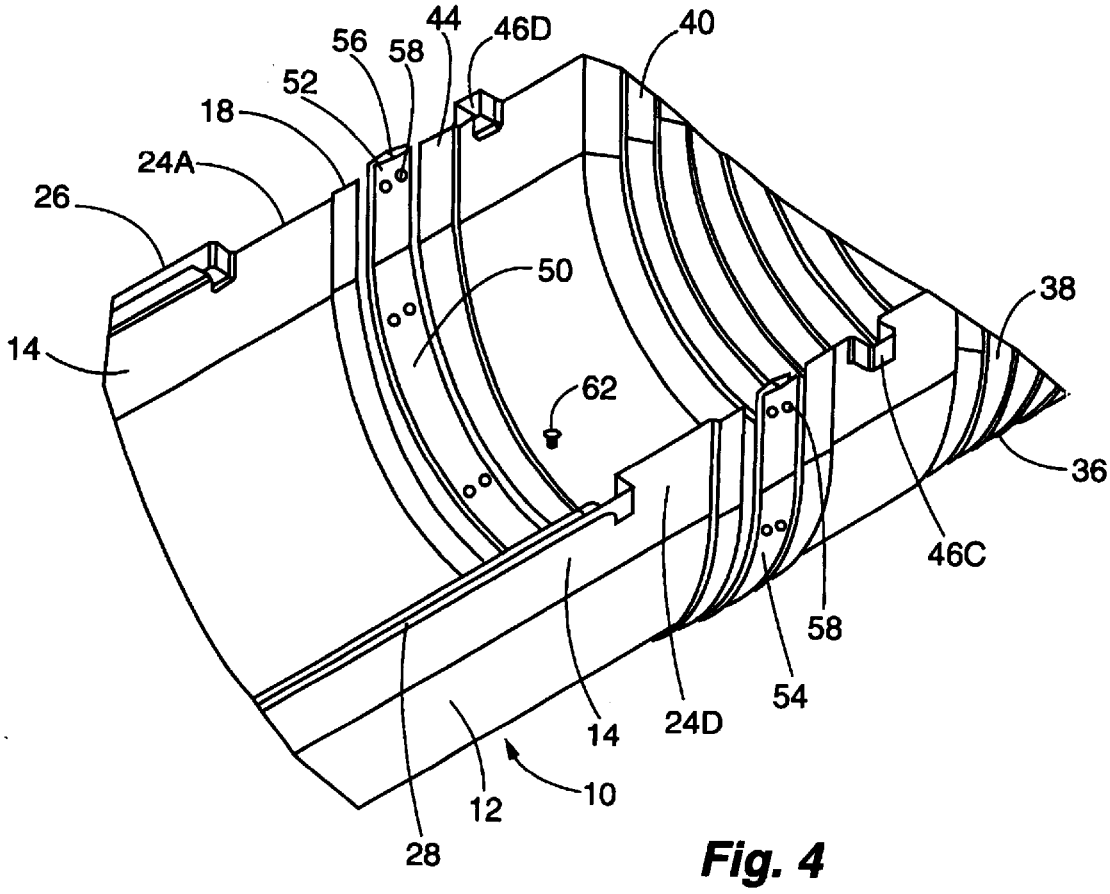
FIG. 4 is an isometric view of assembled liner conduits.

Referring now to FIGS. 3A, 3B and 3C, there are shown isometric and cross-section views of a connector for connecting abutting conduits and a cross-section of connected conduits, and a rivet for attaching the connector to adjoining conduits, respectively. In a preferred embodiment of the present invention, abutting conduits are connected with minimum flow restrictions or projections that may catch debris in the irrigation flow stream. FIG. 3A depicts connecting joint 50 that is formed by inner wall 52 and outer wall 54 connected by spacer 56. In accordance with one embodiment of the present invention, inner wall 52 has a diameter generally the same diameter as the inner diameter of adjacent conduits to form a smooth flow surface as shown in FIG. 4. Rivet holes 58 are provided for rivets 63 (FIG. 3C) to attach connection joint 50 to adjoining conduits. It will be appreciated that holes are formed in conduit sections after the sections are joined with connector 50 in a field installation and rivets 63 are simply snapped into place.

FIG. 3B is a cross-section of connector 50 where inner wall 52 and outer wall 54 define middle portions joined by spacer 56. Inner wall 52 and outer wall 54 then converge to end portions 60A, 60B to form resilient surfaces that engage connector flanges (see, e.g., flanges 18, 22, in FIG. 1; flanges 42, 44 in FIG. 2) of the conduits. The resilient surfaces act to seal against the connector flanges to minimize water leakage without gaskets, which are hard to align and seal.

FIG. 3C is a pictorial illustration of rivet 63 for securing connector 50 (FIGS. 3A, 3B) to connector flanges formed on conduits 10 (FIG. 1) and 36 (FIG. 2). Rivet 63 is designed to merely be pressed into place in the field.

FIG. 4 depicts an isometric view of an exploded joint with first conduit connecting flange 18 and second connecting flange 44 to be captured within connecting joint 50 by converging inner wall 52 and outer wall 54. The converging walls capture offset flanges 18 and 44 so that inner wall 52 is generally flush with the inner walls of the abutting conduits. Spacer 56 forms the seal between flanges 18 and 44.

It will be appreciated that adjacent conduits sections may be connected by additional sections that are not part of the present invention to provide for outputting water onto areas that are to be irrigated. Such sections may take many convenient forms. In the simplest form, connecting joint 50 (FIG. 4) is simply split along connecting ridge 56 and a box is inserted with a gated outlet connection.

A wide variety of dimensions and materials may be selected for the irrigation ditch liner system described above. Typical section lengths may be about five feet, six inches, which can be handled by a single person. The section configurations preferably are formed by standard rotational molding techniques so that conventional plastic materials may be used. Rotational processes are well known and are not described herein.

The foregoing description of the preferred embodiments of my irrigation ditch liner has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An irrigation ditch liner system comprising:

a plurality of liner sections including at least one straight conduit section and one corrugated conduit section, each said conduit having a semi-cylindrical body portion defining a conduit interior diameter, integral vertical walls extending from said semi-cylindrical body portion, and end sections each having extending end flanges; and a semi-cylindrical connector piece having an outer wall and an inner wall connected by a spacer intermediate end portions of said outer wall and said inner wall, said inner wall and said outer wall converging toward said end portions effective to seal against said extending end flanges of adjacent liner sections.

2. An irrigation ditch liner system according to claim 1, wherein said vertical walls define extending brackets for use in securing said liner sections along said irrigation ditch.

3. An irrigation ditch liner system according to claim 1, wherein said straight conduit section includes longitudinal flanges depending from said vertical sides.

4. An irrigation ditch liner system according to claim 2, wherein said straight conduit section includes longitudinal flanges depending from said vertical sides.

5. An irrigation ditch liner system according to claim 1, where said corrugated conduit section has corrugations effective to provide flexibility for said corrugated conduit section to conform to a meandering irrigation ditch.

* * * * *